US007069698B2

(12) United States Patent
Nee

(10) Patent No.: US 7,069,698 B2
(45) Date of Patent: Jul. 4, 2006

(54) METHOD AND APPARATUS FOR COUPLING STRUCTURES TO ROOFING

(76) Inventor: Stephen F. Nee, 80 Indian Ridge Rd., Contoocook, NH (US) 03229

( * ) Notice: Subject to any disclaimer, the term of this patent is extended or adjusted under 35 U.S.C. 154(b) by 100 days.

(21) Appl. No.: 10/424,402

(22) Filed: Apr. 28, 2003

(65) Prior Publication Data

US 2003/0219568 A1 Nov. 27, 2003

Related U.S. Application Data

(60) Provisional application No. 60/376,247, filed on Apr. 29, 2002.

(51) Int. Cl.
*E04D 13/00* (2006.01)

(52) U.S. Cl. ..... 52/24; 52/25; 52/26

(58) Field of Classification Search ..... 52/24, 52/25, 26, 783.1, 796.1, 408, 409, 411
See application file for complete search history.

(56) References Cited

U.S. PATENT DOCUMENTS

| | | | | | |
|---|---|---|---|---|---|
| 401,559 | A * | 4/1889 | Hawthorne | 52/25 |
| 956,647 | A * | 5/1910 | Salls | 52/24 |
| 1,530,233 | A * | 3/1925 | Campbell | 52/24 |
| 1,732,936 | A * | 10/1929 | Hudson | 52/24 |
| 2,041,929 | A * | 5/1936 | Hitzman | 52/96 |
| 2,109,447 | A * | 2/1938 | Sadtler | 52/15 |
| 3,296,750 | A * | 1/1967 | Zaleski | 52/24 |
| 3,305,980 | A * | 2/1967 | Locher | 52/24 |
| 3,583,113 | A * | 6/1971 | Winski | 52/144 |
| 4,003,175 | A | 1/1977 | Patry | 52/506 |
| 4,744,187 | A | 5/1988 | Tripp | 52/410 |
| 4,852,323 | A | 8/1989 | Kartfilt | 52/410 |
| 4,932,171 | A * | 6/1990 | Beattie | 52/58 |
| 5,152,107 | A * | 10/1992 | Strickert | 52/24 |
| 5,664,374 | A * | 9/1997 | Lee | 52/24 |
| 5,890,324 | A * | 4/1999 | Maanum | 52/24 |
| 5,975,239 | A * | 11/1999 | Castaneda | 182/45 |
| 6,055,786 | A * | 5/2000 | Hubbard et al. | 52/409 |
| 6,223,477 | B1 | 5/2001 | Alley | 52/24 |
| D446,319 | S | 8/2001 | Rubenacker | D25/199 |
| 6,298,608 | B1 | 10/2001 | Alley | 52/25 |
| 6,385,914 | B1 | 5/2002 | Alley | 52/25 |
| 6,536,166 | B1 | 3/2003 | Alley | 52/25 |
| 6,668,491 | B1 * | 12/2003 | Bonerb | 52/1 |
| 6,904,731 | B1 * | 6/2005 | Wardle et al. | 52/746.11 |
| 2003/0005658 | A1 * | 1/2003 | Folkersen | 52/408 |
| 2003/0166767 | A1 * | 9/2003 | Foreman et al. | 524/504 |
| 2003/0175449 | A1 * | 9/2003 | Edson | 428/15 |

* cited by examiner

*Primary Examiner*—Peter M. Cuomo
*Assistant Examiner*—Sarah B. McPartlin
(74) *Attorney, Agent, or Firm*—Hayes Soloway PC

(57) ABSTRACT

An apparatus and method of coupling structures to a roof is made up of a multi-layered roofing assembly having a structure with a first portion disposed between the layers and a second portion disposed outside the layers. The structure may be embodied as a snow guard to help maintain snow on a roof or as a cable holder to help space a cable from a roof surface.

19 Claims, 9 Drawing Sheets

METHOD AND APPARATUS FOR COUPLING STRUCTURES TO ROOFING

CROSS-REFERENCE TO RELATED APPLICATIONS

This application claims the benefit of U.S. Provisional Patent Application No. 60/376,247, filed Apr. 29, 2002, and entitled "Snow Guard for Roofing," which is incorporated herein by reference in its entirety.

FIELD OF THE INVENTION

The present invention relates to coupling structures to roofing.

BACKGROUND OF THE INVENTION

It is often desirable to secure a snow guard to a roof to prevent the snow and ice that accumulates on the roof from falling off.

Roofs are well known in the art and include, for example, metal roofs, shingle roofs, and membrane roofs. Roofs typically contain an outer layer, such as metal panels, shingles, or a rubber membrane, attached to a substrate layer, such as plywood, oriented strand board, or particle board. The substrate layer may be supported by wooden rafters or steel decking.

In a metal roof, the outer layer typically comprises a plurality of abutting metal panels, each running the length of the roof. The panels are laid side by side to cover the width of the roof, and the abutting panels are typically crimped together to form a water-resistant joint. Snow guards are typically attached to a metal roof by placing the snow guard over a portion of the water-resistant joint and securing the snow guard to the joint via set screws or other fastening means.

In a shingle roof, the outer layer typically comprises multiple rows of shingles placed in ascending fashion on the substrate layer, optionally with tar paper therebetween. Snow guards are typically attached to a shingle roof by placing the snow guards onto the outer layer of the shingles and driving screws through the snow guard into the substrate layer of the roof.

In a membrane roof, the outer layer typically comprises a rubber membrane that covers the substrate layer of the roof. Snow guards are typically attached to a membrane roof by securing a base of the snow guard to the substrate layer via screws, placing the membrane over the substrate layer and base of the snow guard, removing a portion of the membrane so that a portion of the base is exposed therethrough, and then securing an upper portion of the snow guard to the exposed portion of the base.

In areas that experience very heavy snow fall and/or ice buildup, an extreme load is often placed on the snow guard from the snow and ice which has accumulated on the roof. The load pressing against the snow guard creates a torque thereon, potentially causing the trailing edge of the snow guard to lift from the roof. When this occurs, the leading edge of the snow guard could cut into the outer layer of the roof, causing the roof to leak. Where the load on the snow guard is excessive, the snow guard could be torn from the roof.

An example of the above-mentioned is provided by U.S. Pat. No. 6,298,608, filed Feb. 1, 1999, to William F. Alley, in which there is described a snow guard assembly that contains a block having a base and a top, a snow guard attached to the block, and two rods, whereas each rod has a first and a second terminal end and a predetermined length therebetween. The first terminal end of each rod is attached to the base of the block. To secure the block to the roof, two holes are placed through the outer and substrate layers of the roof. The base of the block is placed in juxtaposition with the outer layer of the roof, with the second terminal ends of the two rods located through the holes in the roof. The length of the two rods is sufficient to allow the second terminal ends thereof to extend below the substrate layer of the roof. A first and second securement device is located on the portion of the first and second rods, respectively, protruding from the substrate layer of the roof to secure the second terminal ends of the two rods below the substrate layer of the roof, thereby securing the block to the roof. A mounting bracket is optionally located between the base of the block and the outer layer of the roof, and a lock plate is optionally located between the substrate layer of the roof and the first and second securement devices. The snow guard assembly of U.S. Pat. No. 6,298,608 is relatively expensive to manufacture, and is time consuming to install.

In addition, tall structures, such as buildings, are often protected from lightning by lightning rods mounted to, and spaced along the roofline. The lightning rods are typically coupled together by a braided cable with one end of the cable being coupled to a copper rod buried in the ground. There is a need for an apparatus and method of coupling the braided cable to a membrane roof that spaces the cable from the roof in order to reduce abrasions that adversely affect the useful life of the roof.

SUMMARY OF THE INVENTION

Briefly described, the invention is an apparatus and method for coupling structures to roofing.

The present invention can be viewed as providing a roofing assembly. The roofing assembly contains a first membrane having an opening extending from a first surface of the first membrane to a second surface of the first membrane. A second membrane is bonded to the second surface of the first membrane along a perimeter of the first membrane. The roofing assembly also has a structure having a first portion disposed between the first membrane and the second membrane, and a second portion disposed adjacent to the first surface of the first membrane.

Other apparatus, methods, features, and advantages of the present invention will be or become apparent to one with skill in the art upon examination of the following drawings and detailed description. It is intended that all such additional methods, features, and advantages be included within this description, be within the scope of the present invention, and be protected by the accompanying claims.

BRIEF DESCRIPTION OF THE DRAWINGS

The present invention will be more fully understood from the detailed description given below and from the accompanying drawings of the embodiments of the invention, which however, should not be taken to limit the invention to any specific embodiment, but are for explanation and for better understanding. Furthermore, the drawings are not necessarily to scale, emphasis instead being placed upon clearly illustrating the principles of the invention. Finally, like reference numerals in the figures designate corresponding parts throughout the several drawings.

DETAILED DESCRIPTION

The present invention is directed to a method and apparatus for coupling structures to roofing. The invention may be embodied in a multi-layer roofing assembly having a structure with a first portion disposed between the layers and a second portion disposed outside the layers, as is described below.

The following provides a description of the present method and apparatus for coupling structures to roofing via two examples. Specifically, the following describes use of the present method and apparatus for attaching snow guards to roofing and cable holders to roofing. It should be noted, however, that the present method and apparatus may be utilized to attach other structures to roofing.

Figure 1:
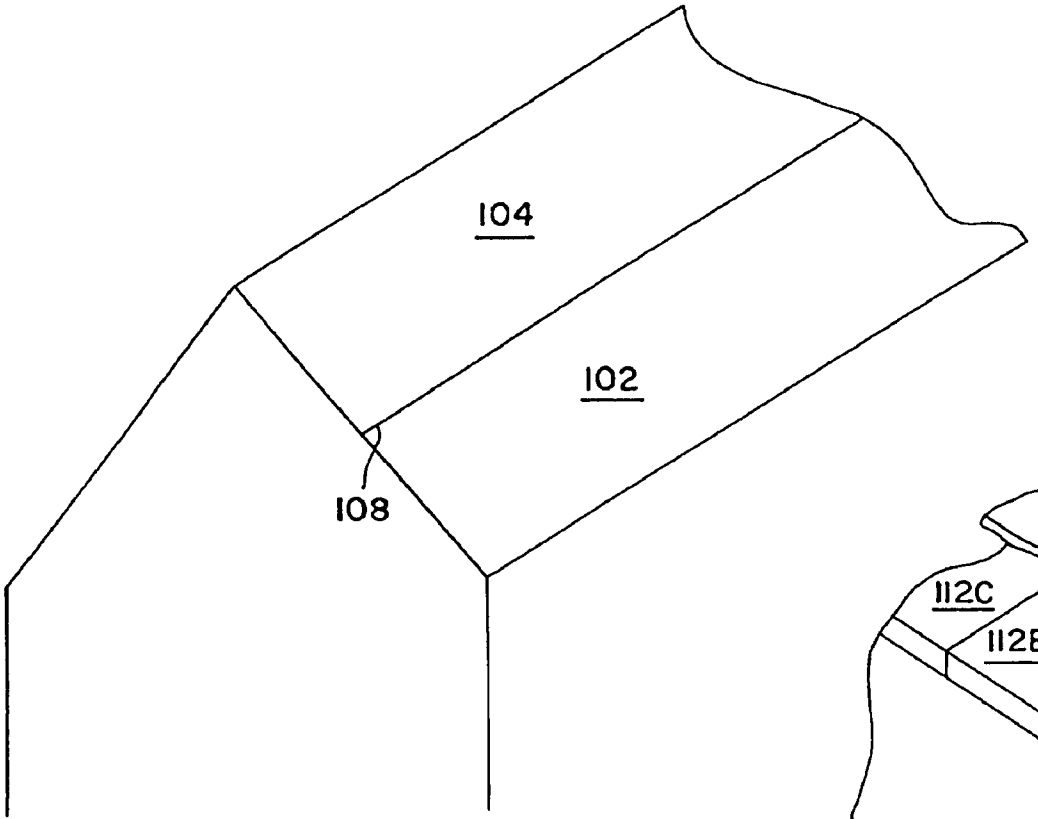
FIG. 1 is a perspective view of a conventional roof.
Figure 2:
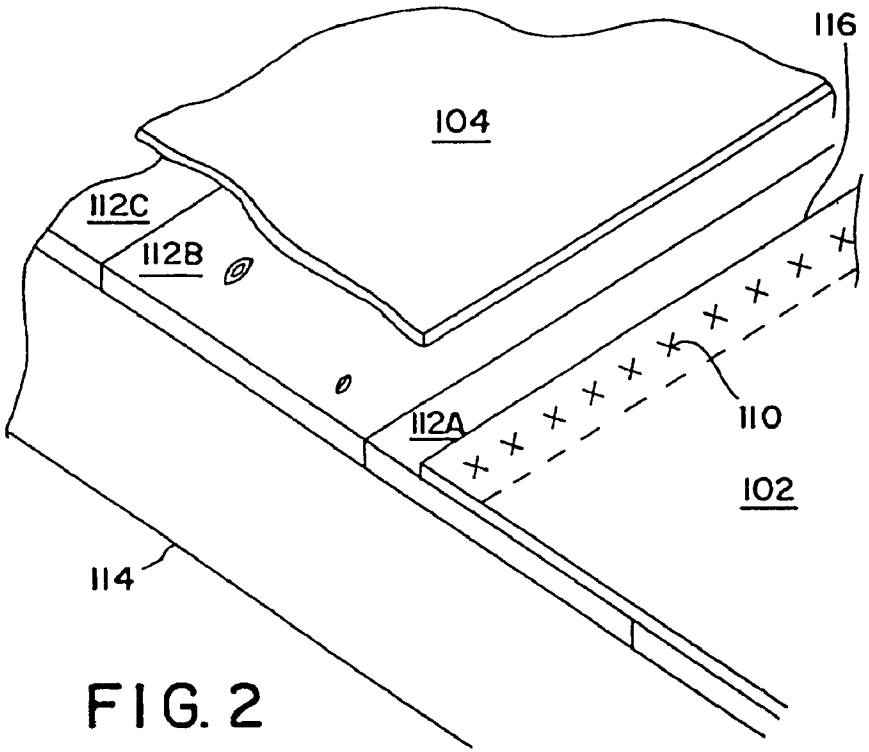
FIG. 2 is a close-up view of a seam of the roof shown in FIG. 1.

FIG. 1 and FIG. 2 show a portion of a roof having a first membrane 102 and a second membrane 104 joined at a seam 108. Roof decking 112A, 112B, and 112C may be secured to the roof structure 114 using traditional means. The roof structure 114 may be made of wooden rafters or metal decking. The first membrane 102 may be secured to the roof decking 112A, 112B, and 112C using a plurality of fasteners 110, such as screws, staples or nails, along an edge 116. A portion of the second membrane 104 is then layered on top of the first membrane 102, forming an overlap. The overlap may be 2–10" in width. The first membrane 102 and the second membrane 104 may be bonded together, via use of, for example, an adhesive such as roofing cement, using hot air welding or a butylene pressure sensitive tape or the like. The bonding forms a watertight seal.

Figure 3:
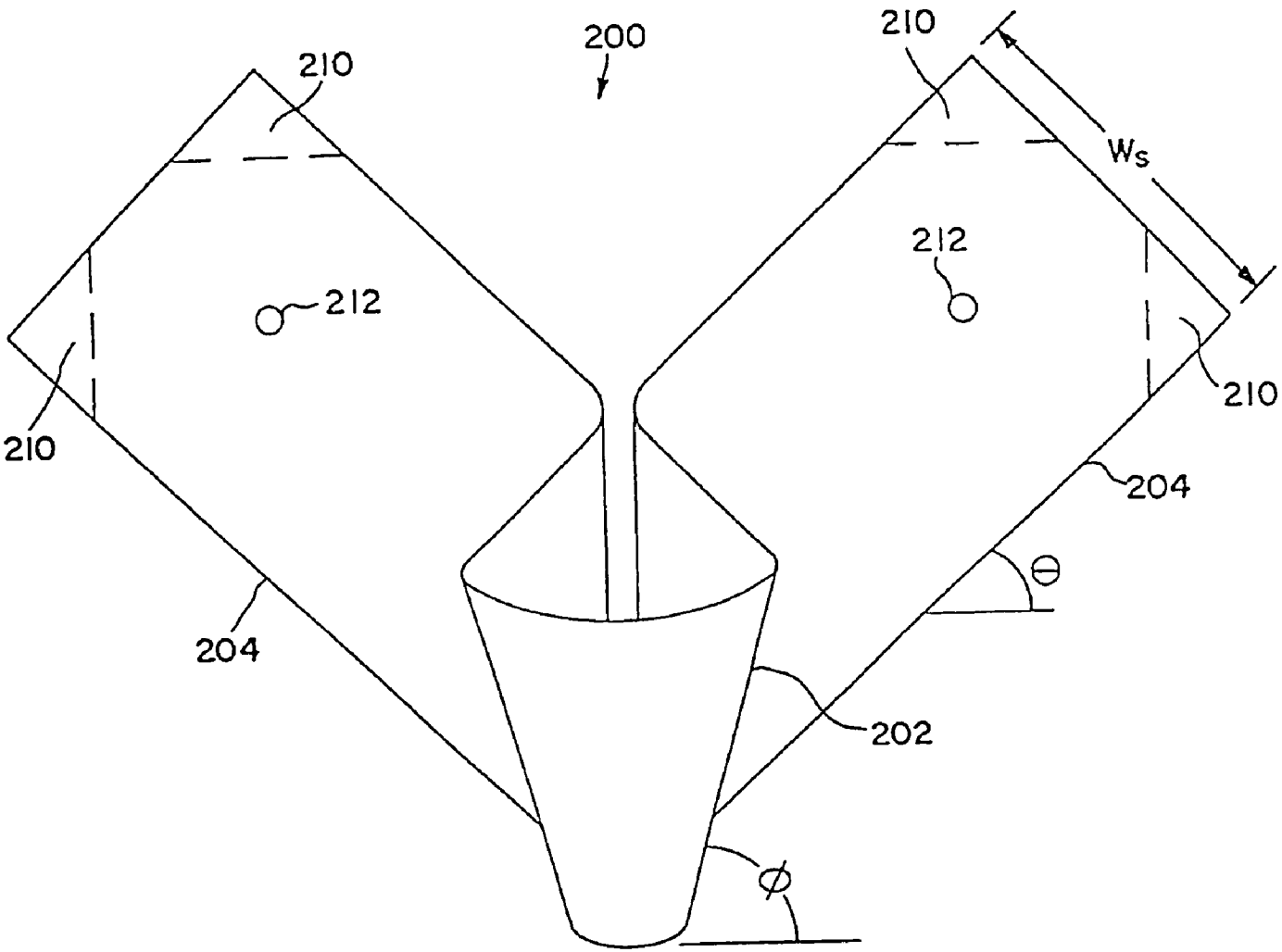
FIG. 3 is a front view of a first embodiment snow guard, in accordance with the present invention.

FIG. 3 is a front view of a snow guard 200. The snow guard 200 may be formed from metallic sheet stock. Preferably, the snow guard material is galvanized steel, copper, or aluminum having a thickness in the range of 0.02" to 0.08", more preferably 0.040" and a width $W_S$ having a range of 1" to 12", preferably 2.25". In accordance with a first exemplary embodiment of the invention, the snow guard 200 is made from 20 ounce cold rolled copper. The snow guard material may also be coated with a polymeric material, for example polyvinyl chloride (PVC). In addition, the snow guard 200 may be formed using conventional metal working tools. Further, the snow guard 200 may be generally square in shape having sides measuring 3" to 18", preferably 5.25". Other shapes, including rectangles and diamonds, are contemplated and considered within the invention.

The snow guard 200 may have a pocket 202 and at least one tab 204, although two tabs are preferred. The tabs 204 may extend upward at an angle θ to the horizontal, wherein the angle θ is preferably 15° to 75°, more preferably 30° to 60°, and most preferably 45°. The pocket 202 may be formed in the shape of an inverted, truncated cone. The pocket 202 may extend upward at an angle Φ to the horizontal, wherein the angle Φ may be 45° to 80°, and preferably is 75°.

The snow guard 200 may be installed on shingled roofs, for example fiberglass, asphalt, and slate roofs. Upon installation of a first row of shingles, the snow guard 200 may be secured to the roof decking 112 using nails through holes 212. The holes 212 are covered by a second row of shingles. Snow guards 200 may be added to an existing shingled roof by bending a corner 210 on the tabs 204 forward or backwards. The snow guard 200 with bent corners may then be slid under a shingle and the weight of the shingle and the snow helps retain the snow guard 200 in position.

Figure 4:
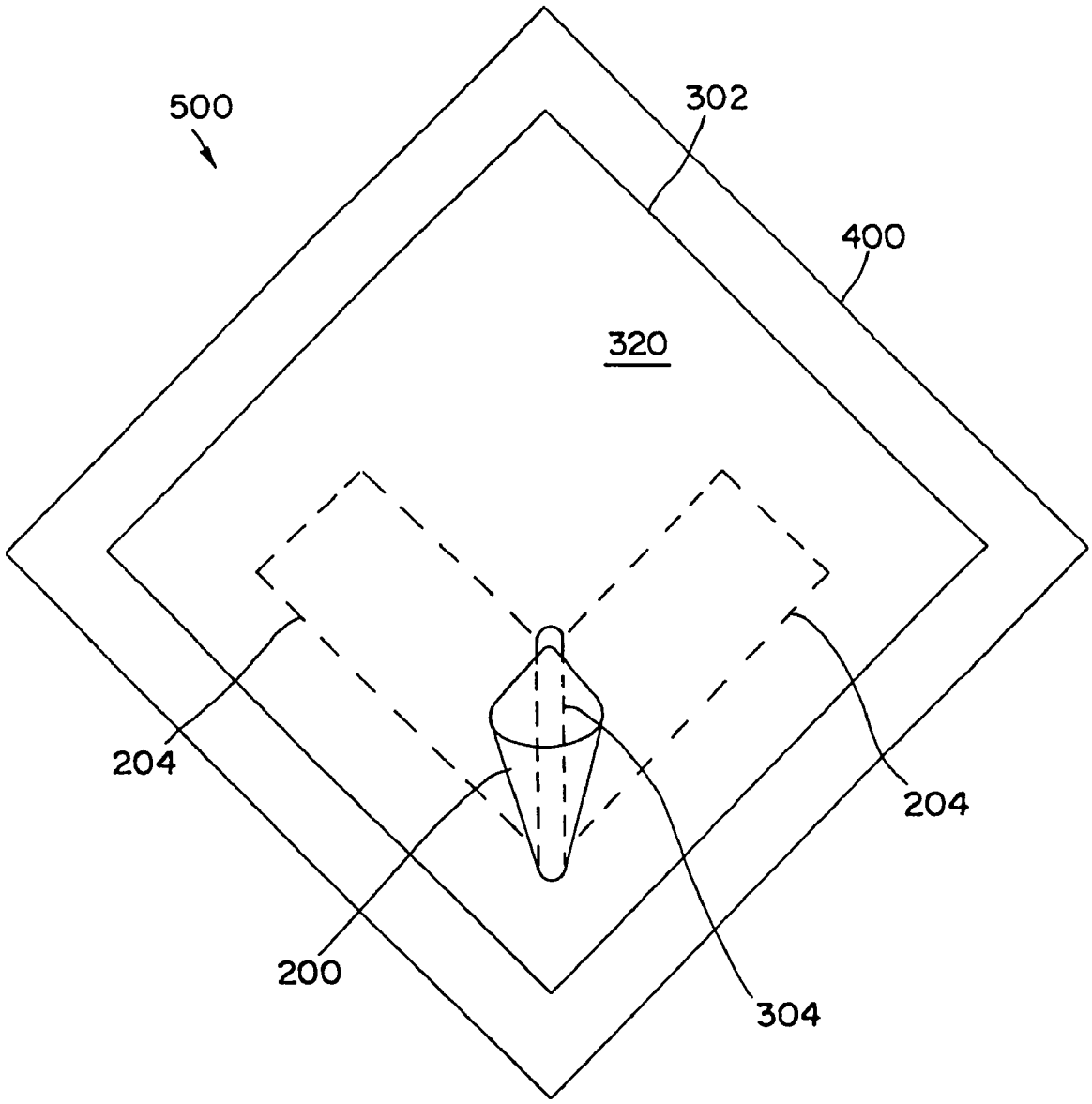
FIG. 4 is a top view of a first embodiment snow guard assembly, in accordance with the present invention.

FIG. 4 shows a snow guard assembly 500 having a first membrane 302, a second membrane 400 and a snow guard 200. The first membrane 302 may be a single or multi-layer roofing membrane, preferably having a thickness of 0.048" to 0.180," and may be available from a membrane manufacturer, for example, The Firestone Tire and Rubber Co., Sarnafil, Inc., or Johns-Manville Corporation. The first membrane 302 may be any roof sheathing material, including but not limited to EPDM (ethylene-propylene diene monomer), PVC (polyvinyl chloride), or a TPO (thermoplastic olefin rubber). The first membrane 302 may have an opening 304 extending from a first surface 320 (see FIG. 5A) of the first membrane 302 to a second surface 322 (see FIG. 5A) of the first membrane 302 to allow the snow guard 200 to be inserted. The snow guard 200 may be inserted with the tabs 204 in contact with each other and then may be spread apart after insertion. An outline of the tabs 204 is shown with hidden lines in FIG. 4.

After the snow guard 200 has been inserted through the opening 304 in the first membrane 302, the first membrane 302 may then be bonded to a second membrane 400 using hot air welding or a butylene pressure sensitive tape, or the like, to form a watertight seal. The second membrane 400 may be the same or different material as the first membrane 302, preferably the same. The first membrane 302 fits within the perimeter of the second membrane 400. The first membrane 302 may be bonded to the second membrane 400 within 0.5" to 1" of the perimeter of the first membrane 302. When particular membrane materials are used, for example PVC, the entire contact area 322 of the first membrane 302 may be bonded to the second membrane 400.

Figure 5A:
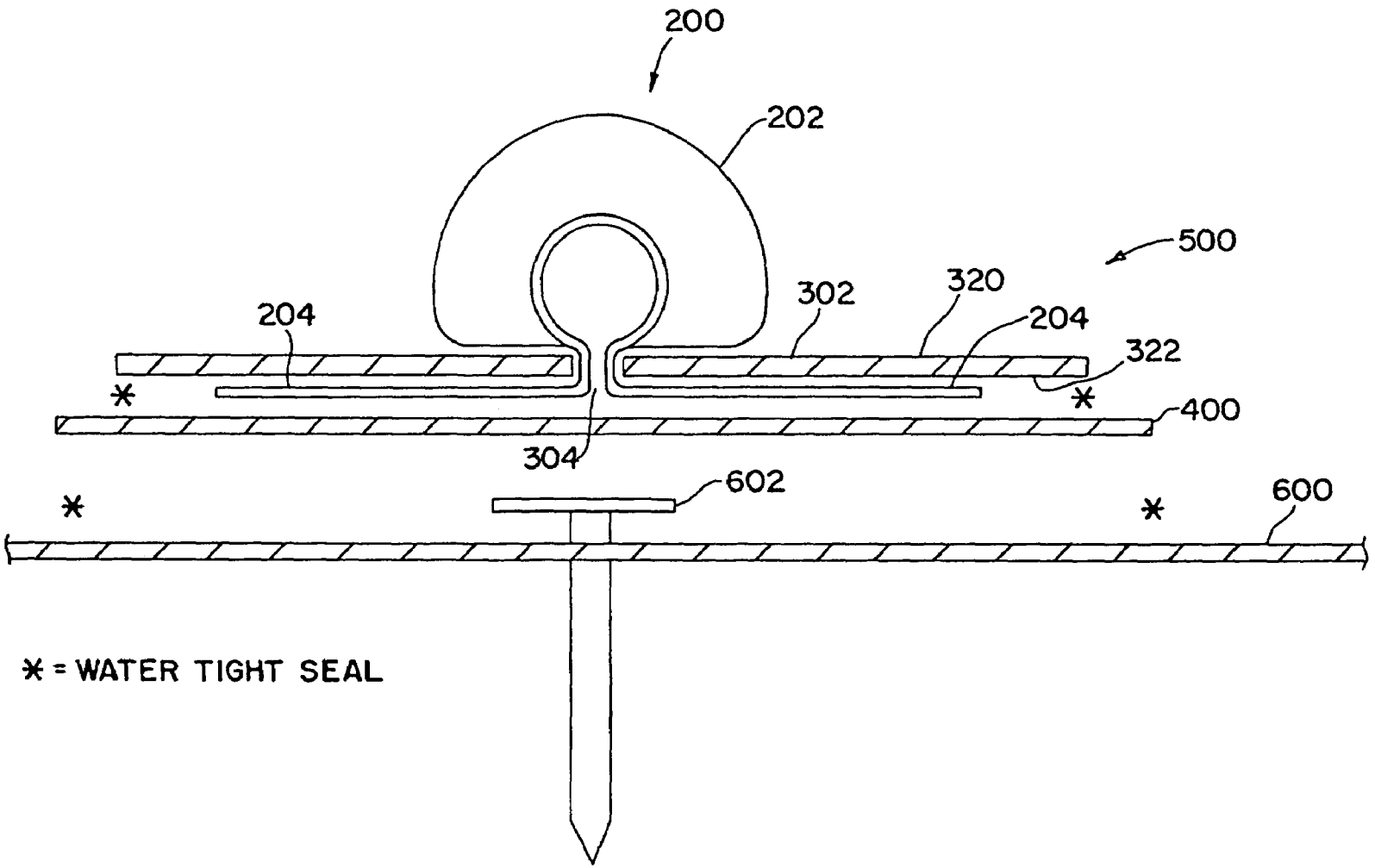
FIG. 5A is an exploded profile view of the first embodiment snow guard assembly being bonded to a roof, in accordance with the present invention.

FIG. 5A is an exploded profile view of a first embodiment snow guard assembly 500 being bonded to a roof membrane 600. The pocket 202 is disposed adjacent a first surface 320 of the first membrane 302 and the tabs 204 are disposed adjacent the second surface 322 of the first membrane 302. An installer may drive a mechanical fastener 602, preferably a roofing screw and plate, through the roof sheathing 600 and into the roof decking 112A, 112B, and 112C in the desired location. The installer may then bond the second membrane 400 to the roof sheathing 600 along the perimeter of the second membrane 400, preferably within 0.5" to 1" of the perimeter. The installer may use hot air welding or a butylene pressure sensitive tape, or the like, to form a watertight seal. The mechanical fastener 602 may provide a local attachment point for the roof sheathing 600 to the roof decking 112A, 112B, and 112C.

Figure 5B:
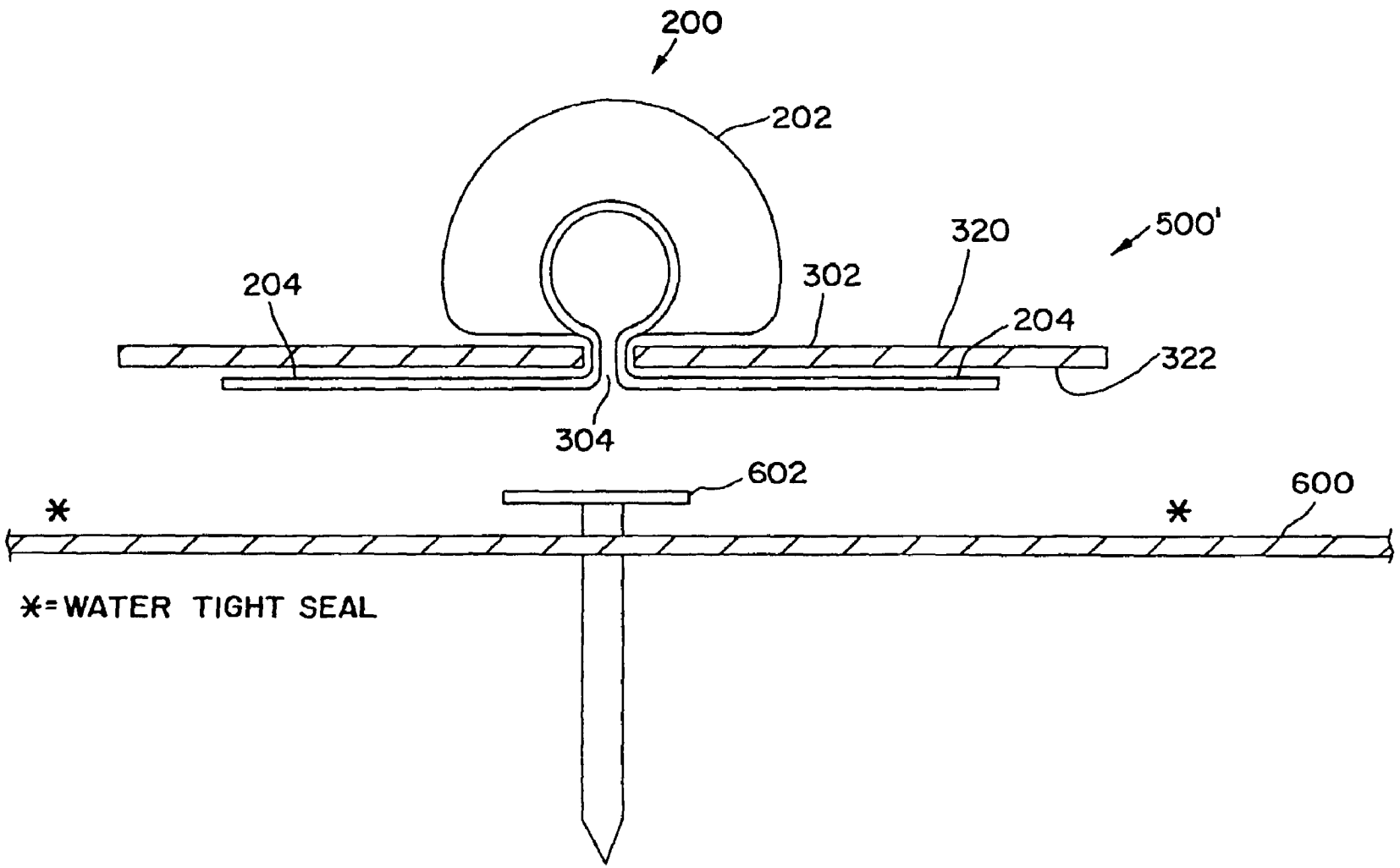
FIG. 5B is an exploded profile view of a second embodiment snow guard assembly being bonded to a roof, in accordance with the present invention.

FIG. 5B is an exploded profile view of a second embodiment snow guard assembly 500' being bonded to a roof membrane 600. The snow guard assembly 500' may include a membrane 302 having an opening 304 extending from a first surface 320 of the first membrane 302 to a second surface 322 of the first membrane 302, and a snow guard 200 having a pocket 202 coupled to at least one tab 204. The pocket 202 is disposed adjacent the first surface 320 of the membrane 302 and the tab 204 is disposed adjacent the second surface 322 of the membrane 302. In this embodiment, the snow guard assembly 500' may be bonded directly to the roof membrane 600 without the need of a second, intermediate membrane.

Figure 6:
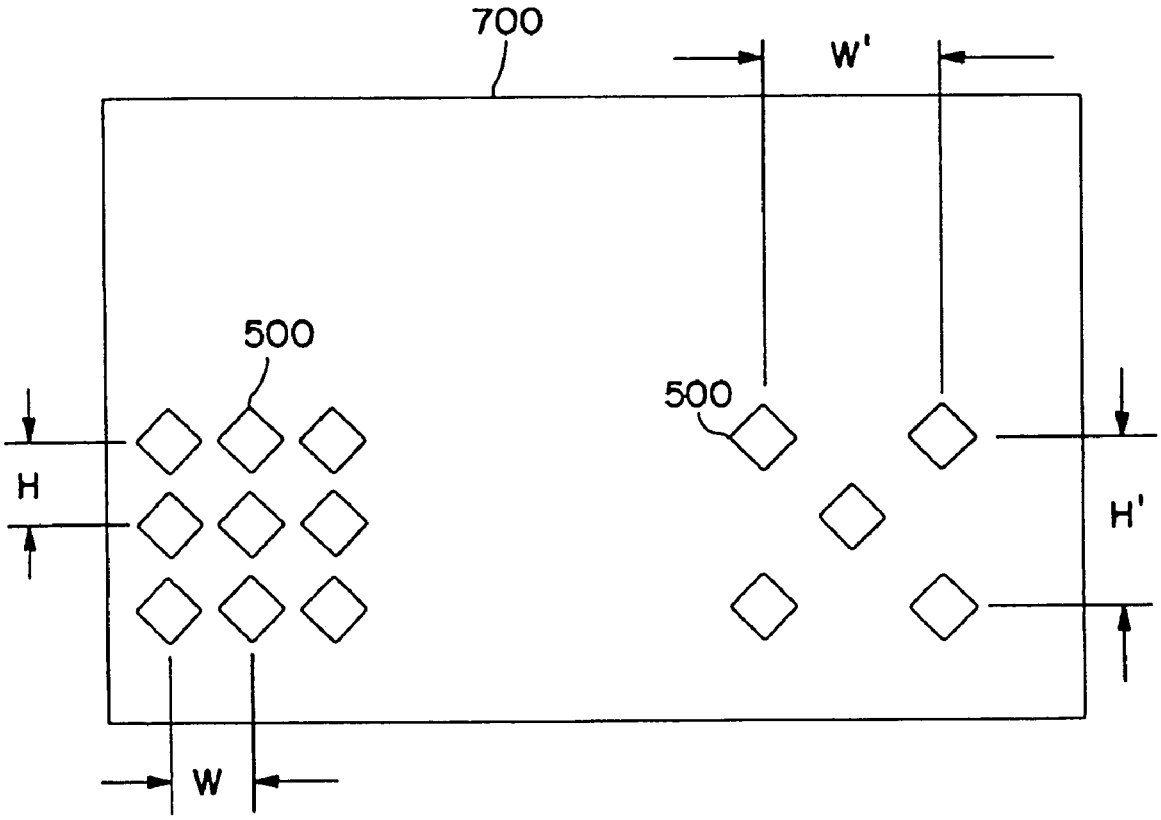
FIG. 6 is a top view of a roof illustrating an installation of the present invention.

FIG. 6 is a top view of a roof 700 illustrating an installation of the snow guard assembly 500. As shown in FIG. 6, the snow guard assemblies 500 may be secured in a predetermined and structured pattern. As an example, the assemblies 500 may be spaced on a square grid separated by a height H (1–6') and a width W (1–6'), or a diamond pattern having a height H' (2–12') and a width W' (2–12'). The pattern may extend a distance up the roof 700. Alternatively, the assemblies 500 may be located in a single row along a bottom edge of the roof and spaced 1–6' apart. The spacing of the snow guard assemblies 500 can be varied without departing from the present invention.

When snow falls it lands on the roof 700 and fills the pocket 202. The snow in the pocket 202 and around the pocket 202 forms a unitary structure, where the pocket 202 helps maintain the snow in one piece until it melts.

In accordance with a third embodiment of the invention, a snow guard assembly may have a snow guard 200 formed from a polymeric material and may be bonded to the first membrane 302 using ultrasonic welding.

In the unfortunate event that an excessive snowfall tears a snow guard 200 from the snow guard assembly 500, an installer may simply place a larger snow guard assembly over the prior snow guard assembly and bonded it to the roof membrane.

Figure 7A:
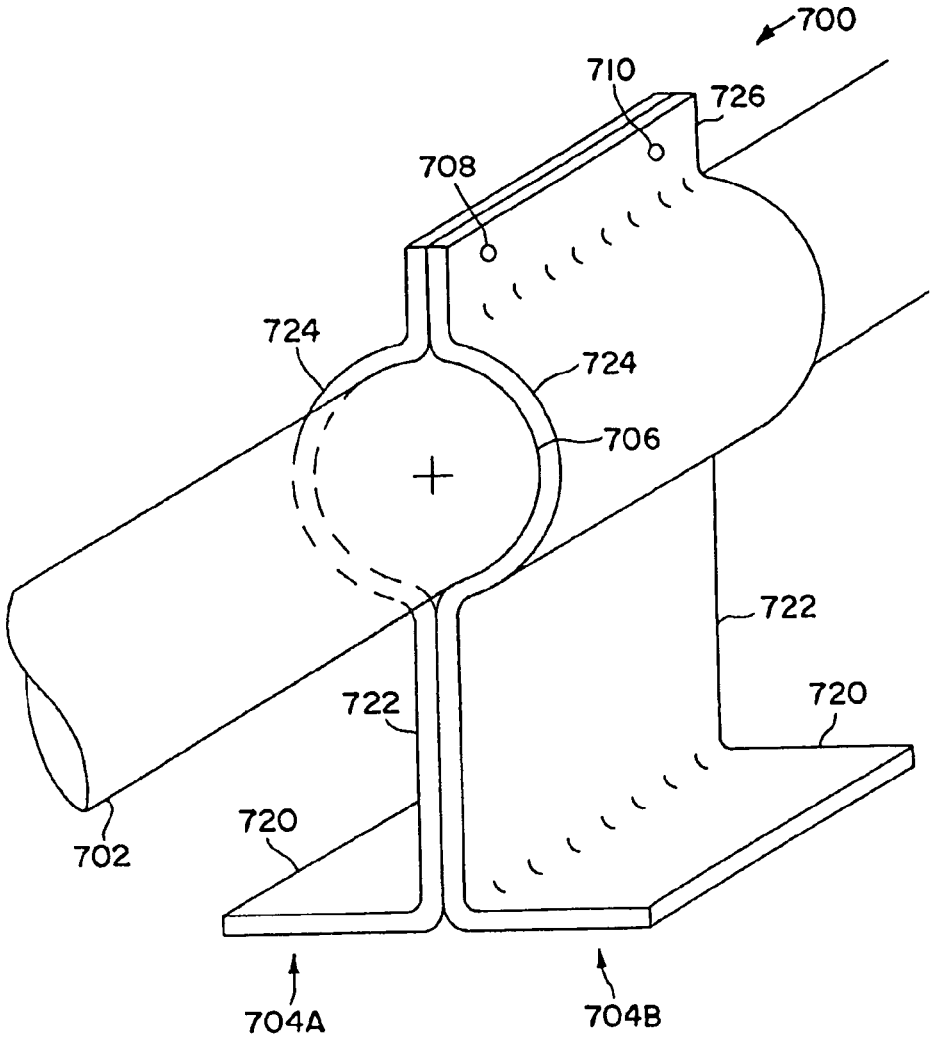
FIG. 7A is a perspective view of a first embodiment cable holder in accordance with the present invention.
Figure 7B:
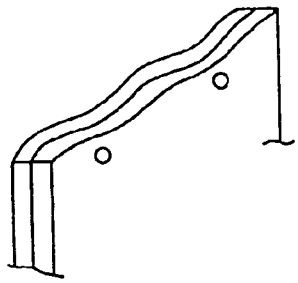
FIG. 7B is a partial perspective view of the first embodiment cable holder of FIG. 7A showing the halves of the cable holder crimped together in accordance with the present invention.

FIG. 7A is a perspective view of a cable holder 700 that maybe coupled to roofing via use of the present method and apparatus, as described below. In accordance with a first exemplary embodiment of the cable holder 700, the cable holder 700 may be made of metallic or polymeric material. In addition, the cable holder 700 may be made of identical cable holder halves 704A and 704B that cooperate to hold a cable 702, typically a braided copper cable, a spaced distance above a membrane roof 600 (See FIG. 9). The cable holder halves 704A and 704B may have a foot portion 720, a spacer portion 722, a cable holding portion 724, and a coupling portion 726. The cable 702 may be held in a cable opening 706 formed when the halves 704A and 704B are coupled together. The coupling portion 726 may have openings 708 and 710 to allow the halves 704A and 704B to be coupled together using screws, bolts, rivets, eyelets, or other mechanical fasteners. The holes 708 and 710 may have the same or different cross sectional areas. As shown in FIG. 7B, the halves 704A and 704B may be coupled together by a mechanical crimp.

Figure 8:
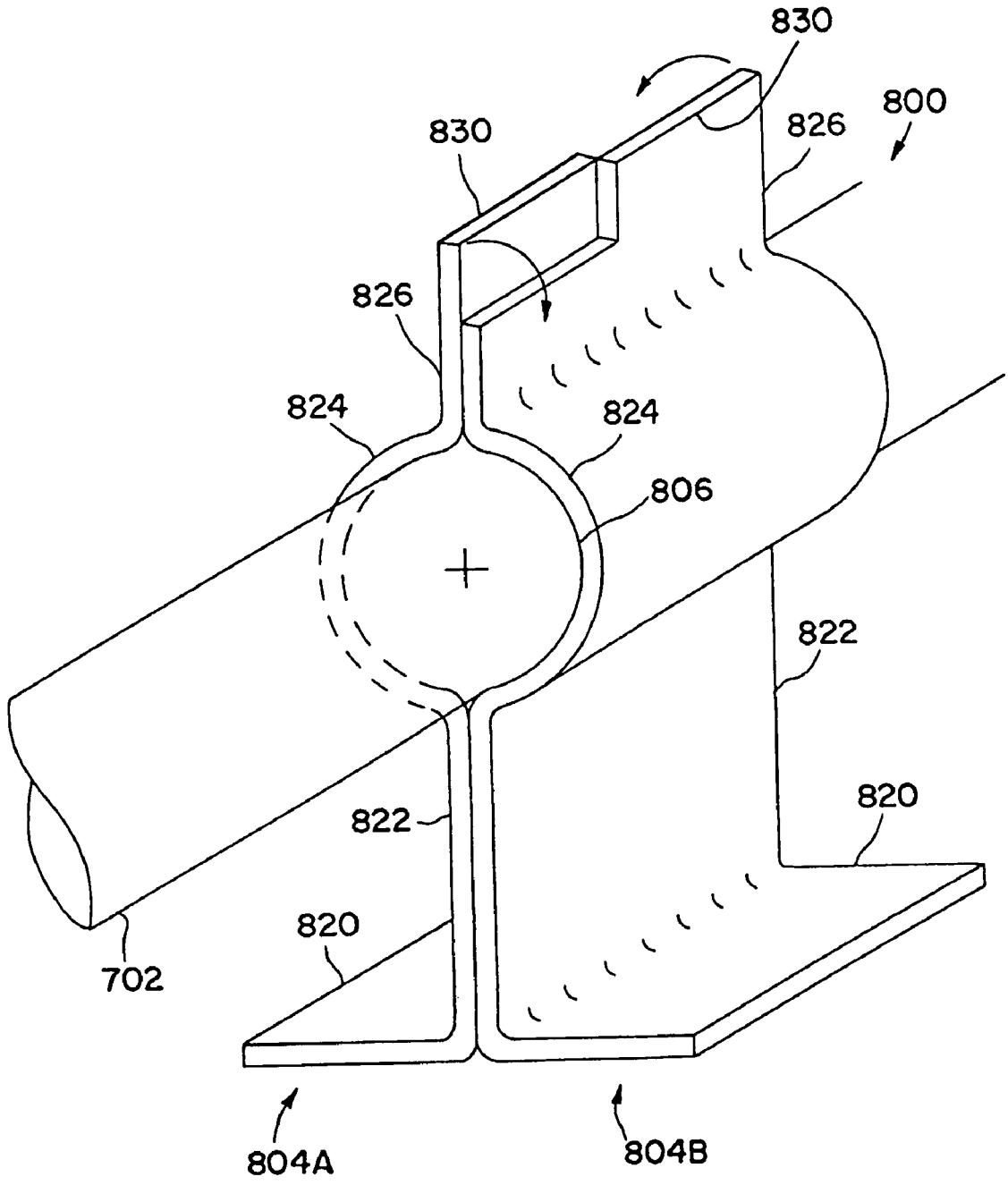
FIG. 8 is a perspectives view of a second embodiment cable holder in accordance with the present invention.

FIG. 8 is a perspective view of a second exemplary embodiment cable holder 800. The cable holder 800 may be used to hold a cable a spaced distance above a membrane roof 600 (See FIG. 9) and the cable holder 800 may be made of metallic or polymeric material. The cable holder 800 may be made of identical halves 804A and 804B that cooperate to hold a cable 702. The cable holder halves 804A and 804B may have a foot portion 820, a spacer portion 822, a cable holding portion 824, and a coupling portion 826. The cable 702 may be held in a cable opening 806 formed when the halves 804A and 804B are coupled together. The coupling portion 826 may have tabs 830 to allow the halves 804A and 804B to be coupled together by bending the tabs 830 over.

Figure 9:
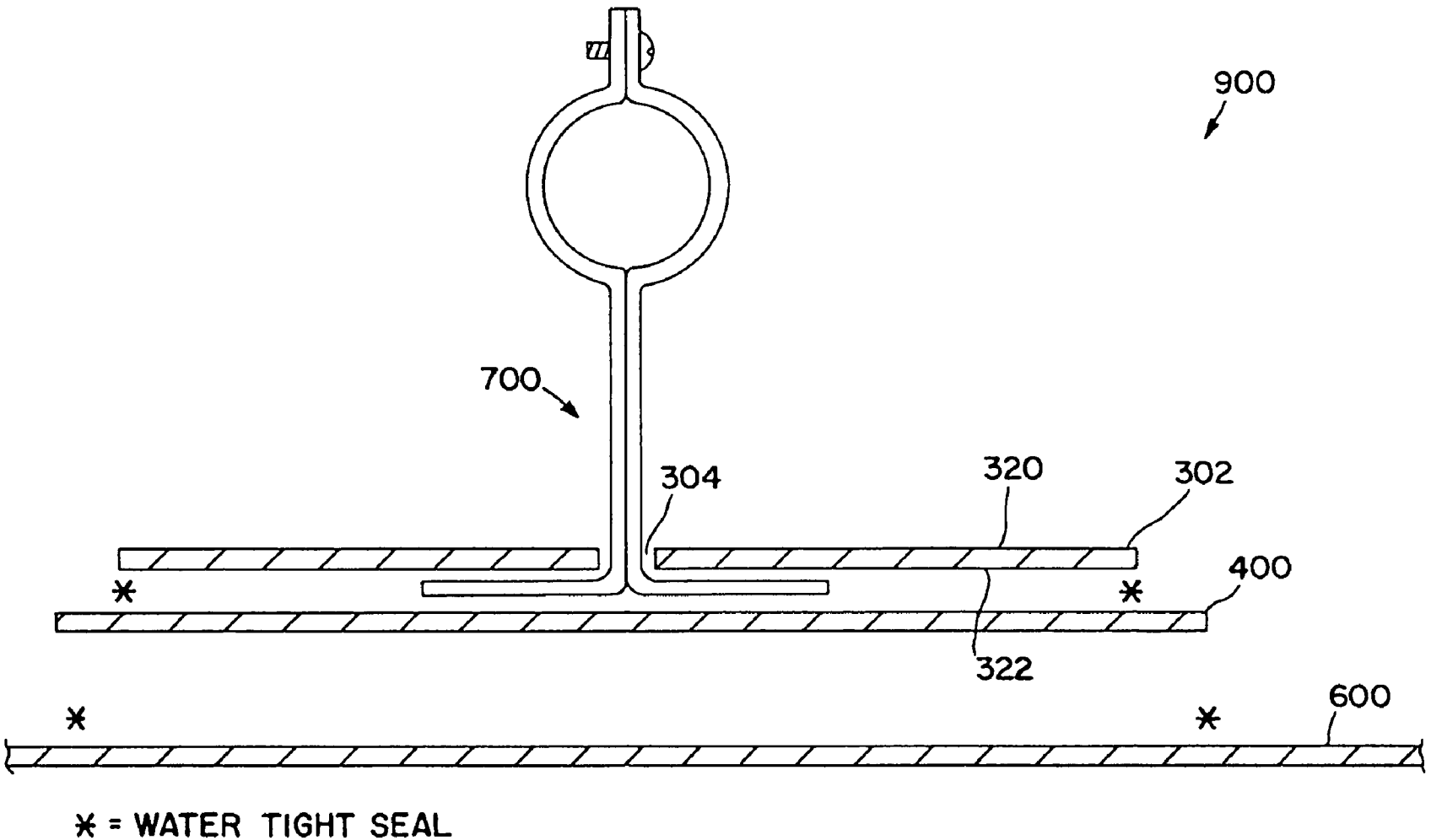
FIG. 9 is an exploded profile view of a cable holder assembly being bonded to a roof in accordance with the present invention utilizing the cable holder of FIG. 7A.

FIG. 9 is an exploded profile view of a cable holder assembly 900, which is bonded to a roof membrane 600. The cable holder assembly 900 may have a first membrane 302, a second membrane 400, and a cable holder 700. The membranes 302 and 400 may be single or multi-layer roofing membranes having characteristics and dimensions similar to that shown in FIG. 5. The first membrane 302 may have an opening 304 formed therein to allow the cable holder 700 to be inserted therein.

After the cable holder 700 has been inserted through the opening 304 in the first membrane 302, the first membrane 302 may then be bonded to the second membrane 400 using hot air welding or a butylene pressure sensitive tape, or the like, to form a watertight seal. The first membrane 302 may be bonded to the second membrane 400 within 0.5" to 1" of the perimeter of the first membrane 302. When particular membrane materials are used, for example PVC, the entire contact area of the first membrane 302 may be bonded to the second membrane 400. The second membrane 400 may be the same or different material as the first membrane, preferably the same. The first membrane 302 fits within the perimeter of the second membrane 400.

The installer may bond the cable holder assembly 900 to the roof membrane 600 along the perimeter of the second membrane 400, preferably within 0.5" to 1" of the perimeter. The installer may use hot air welding or a butylene pressure sensitive tape or the like to form a watertight seal. As shown, the cable holder assembly 900 is electrically isolated from the decking.

It should be understood that, while the present invention has been described in detail herein, the invention can be embodied otherwise without departing from the principles thereof, and such other embodiments are meant to come within the scope of the present invention as defined in the following claims. For example, the first and second membranes may be bonded together using an adhesive such as roofing cement or the like.

I claim:

1. A snow guard assembly, comprising:

a first roofing membrane having an opening extending from a first surface of the first membrane to a second surface of the first membrane, the first roofing membrane having at least four first membrane perimeter sides;

a second roofing membrane having at least four second membrane perimeter sides, wherein at least three of the second membrane perimeter sides are bonded to the second surface of the first roofing membrane along at least three of the first membrane perimeter sides; and a snow guard having a pocket coupled to at least one tab, the pocket disposed adjacent the first surface of the first roofing membrane and the tab disposed adjacent the second surface of the first roofing membrane and the second roofing membrane.

2. The snow guard of claim 1, wherein the first roofing membrane and the second roofing membrane are substantially a same material and the same material is selected from the group consisting of EPDM (ethylene-propylene diene monomer), PVC (polyvinyl chloride), and TPO (thermoplastic olefin rubber).

3. The snow guard of claim 1, wherein the bond is watertight.

4. The snow guard of claim 1, wherein the second membrane is bonded to the second surface of the first membrane along a complete perimeter of the first membrane.

5. The snow guard of claim 1, wherein an edge of the pocket is disposed at angle to a horizontal axis, the angle being greater than 45° and less than 80°.

6. A snow guard assembly, comprising:

a first roofing membrane having an opening extending from a first surface of the first membrane to a second surface of the first membrane;

a second roofing membrane bonded to the second surface of the first membrane along a substantial perimeter of the first membrane;

a snow guard having a pocket coupled to at least one tab, the pocket disposed adjacent the first surface of the first membrane and the tab disposed adjacent the second surface of the first membrane; and wherein an edge of the tab is disposed at angle to a horizontal axis, the angle being greater than 15° and less than 75°.

7. The snow guard of claim 6, wherein the edge of the tab is disposed at angle to a horizontal axis, the angle being greater than 30° and less than 60°.

8. A snow guard assembly, comprising:

a first roofing membrane having an opening extending from a first surface of the first roofing membrane to a second surface of the first roofing membrane, the first roofing membrane having at least four first membrane perimeter sides, the first roofing membrane bonded to a membrane roof along at least three of the first membrane perimeter sides; and a snow guard having a pocket coupled to at least one tab, the pocket disposed adjacent the first surface of the first membrane and the tab disposed adjacent the second surface of the first membrane.

9. The snow guard of claim 8, wherein the first roofing membrane and the membrane roof are substantially a same material and the same material is selected from the group consisting of EPDM (ethylene-propylene diene monomer), PVC (polyvinyl chloride), and TPO (thermoplastic olefin rubber).

10. The snow guard of claim 8, wherein the membrane roof is bonded to the second surface of the first roofing membrane along a complete perimeter of the first membrane.

11. The snow guard of claim 8, wherein an edge of the tab is disposed at angle to a horizontal axis, the angle being greater than 15° and less than 75°.

12. The snow guard of claim 11, wherein the edge of the tab is disposed at angle to a horizontal axis, the angle being greater than 30° and less than 60°.

13. The snow guard of claim 8, wherein an edge of the pocket is disposed at angle to a horizontal axis, the angle being greater than 45° and less than 80°.

14. A roofing assembly, comprising:

a first roofing membrane having an opening extending from a first surface of the first roofing membrane to a second surface of the first roofing membrane, the first roofing membrane having at least four first membrane perimeter sides;

a second roofing membrane having at least four second membrane perimeter sides;

a watertight seal formed between the first roofing membrane and the second roofing membrane along at least three of the first membrane perimeter sides; and a snow guard having a first portion disposed adjacent the first roofing membrane and the second roofing membrane and a second portion disposed adjacent to the first surface of the first roofing membrane said second portion being formed as a pocket.

15. The roofing assembly of claim 14, wherein the watertight seal is a hot air weld.

16. The roofing assembly of claim 14, wherein the watertight seal is butylene pressure sensitive tape.

17. The roofing assembly of claim 14, wherein the first membrane and the second membrane are each further comprised of a substantially same material.

18. The roofing assembly of claim 17, wherein the substantially same material is selected from the group consisting of EPDM (ethylene-propylene diene monomer), PVC (polyvinyl chloride), and TPO (thermoplastic olefin rubber).

19. The roofing assembly of claim 14, wherein substantially all of a contact area of the first roofing membrane is bonded to the second roofing membrane.

* * * * *